US008857931B2

(12) United States Patent
Jung et al.

(10) Patent No.: US 8,857,931 B2
(45) Date of Patent: Oct. 14, 2014

(54) REFRIGERATOR WITH VACUUM SPACE

(75) Inventors: Wonyeong Jung, Gyeongnam (KR); Myungryul Lee, Gyeongnam (KR); Sung Jhee, Gyeongnam (KR)

(73) Assignee: LG Electronics Inc., Seoul (KR)

( * ) Notice: Subject to any disclaimer, the term of this patent is extended or adjusted under 35 U.S.C. 154(b) by 107 days.

(21) Appl. No.: 13/241,611

(22) Filed: Sep. 23, 2011

(65) Prior Publication Data

US 2012/0104002 A1 May 3, 2012

(30) Foreign Application Priority Data

Oct. 28, 2010 (KR) ..... 10-2010-0105893

(51) Int. Cl.

| | |
|---|---|
| ***A47B 96/04*** | (2006.01) |
| ***F25D 23/06*** | (2006.01) |
| ***F25D 23/08*** | (2006.01) |
| *F25D 21/04* | (2006.01) |

(52) U.S. Cl.

CPC ..... *F25D 23/066* (2013.01); *F25D 2201/14* (2013.01); *F25D 23/085* (2013.01); *F25D 21/04* (2013.01)

USPC ..... 312/406.1; 62/273

(58) Field of Classification Search

USPC ..... 312/401, 406, 406.1, 204; 62/272–273, 62/248, 465; 428/49; 52/788.1

See application file for complete search history.

(56) References Cited

U.S. PATENT DOCUMENTS

| | | | | | |
|---|---|---|---|---|---|
| 1,543,349 | A | * | 6/1925 | Walker | 220/592.02 |
| 1,561,769 | A | * | 11/1925 | Ballew | 220/592.05 |
| 1,588,707 | A | * | 6/1926 | Csiga | 220/592.05 |
| 3,161,265 | A | * | 12/1964 | Matsch et al. | 52/788.1 |
| 4,485,639 | A | * | 12/1984 | Sakamoto | 62/505 |
| 4,514,450 | A | * | 4/1985 | Nowobilski et al. | 428/120 |
| 4,870,735 | A | * | 10/1989 | Jahr et al. | 29/890.035 |
| 5,157,893 | A | * | 10/1992 | Benson et al. | 52/789.1 |
| 5,189,888 | A | * | 3/1993 | Anderson et al. | 62/248 |

(Continued)

FOREIGN PATENT DOCUMENTS

| | | |
|---|---|---|
| CN | 2033487 U | 3/1989 |
| CN | 1276055 A | 12/2000 |

(Continued)

OTHER PUBLICATIONS

CN201458112U Translation.*

(Continued)

*Primary Examiner* — Janet M Wilkens
*Assistant Examiner* — Andrew Roersma
(74) *Attorney, Agent, or Firm* — Fish & Richardson P.C.

(57) ABSTRACT

A refrigerator includes a body having a storage space. The body includes an inner case having the storage space, an outer case having an inside surface spaced a predetermined gap from an outside surface of the inner case to house the inner case, a vacuum space provided between the inner case and the outer case sealed to maintain a vacuum state for heat insulating between the inner case and the outer case, a supporting portion provided to contact with the outside surface of the inner case and the inside surface of the outer case to maintain a spaced state of the vacuum space, and a dewing preventive unit adjacent to the supporting portion for preventing dewing from taking place at the outer case by suppressing surface temperature drop of the outer case caused by cold conducted from the inner case to the outer case through the supporting portion.

18 Claims, 7 Drawing Sheets

(56) References Cited

U.S. PATENT DOCUMENTS

| | | | | |
|---|---|---|---|---|
| 6,038,830 | A | 3/2000 | Hirath et al. | |
| 6,220,685 | B1 * | 4/2001 | Hirath et al. | 312/406 |
| 6,408,841 | B1 | 6/2002 | Hirath et al. | |
| 6,666,043 | B2 * | 12/2003 | Lee | 62/283 |
| 6,725,624 | B2 * | 4/2004 | Hirath et al. | 52/800.11 |
| 7,293,847 | B2 * | 11/2007 | Lee et al. | 312/406.2 |
| 7,665,810 | B2 * | 2/2010 | Crompton et al. | 312/204 |
| 2002/0041134 | A1 | 4/2002 | Wolf et al. | |
| 2002/0100250 | A1 | 8/2002 | Hirath et al. | |
| 2004/0226956 | A1 * | 11/2004 | Brooks | 220/592.02 |

FOREIGN PATENT DOCUMENTS

| | | | | | |
|---|---|---|---|---|---|
| CN | 1364229 | A | | 8/2002 | |
| CN | 1590941 | A | | 3/2005 | |
| CN | 1860326 | A | | 11/2006 | |
| CN | 201458112 | U | * | 5/2010 | B65D 88/74 |
| EP | 1 208 339 | B1 | | 8/2007 | |
| JP | 11-500074 | A | | 1/1999 | |
| JP | 11118336 | A | * | 4/1999 | F25D 23/02 |
| JP | 11-159694 | A | | 6/1999 | |
| JP | 2002-117449 | A | | 4/2002 | |
| KR | 10-2001-0022959 | A | | 3/2001 | |
| WO | WO 01/07848 | A1 | | 2/2001 | |
| WO | WO 2006/009063 | A1 | | 1/2006 | |

OTHER PUBLICATIONS

Korean Notice of Allowance dated Apr. 24, 2012 for Application No. 10-2010-0105893, with English Translation, 3 pages.

Chinese Office Action dated Sep. 16, 2013 for Application No. 201110332398.5, with English Translation, 13 pages.

* cited by examiner (a)

(b)

(a)

(b)

REFRIGERATOR WITH VACUUM SPACE

CROSS REFERENCE TO RELATED APPLICATION

This application claims the benefit of the Patent Korean Application No. 10-2010-0105893, filed on Oct. 28, 2010, which is hereby incorporated by reference as if fully set forth herein.

BACKGROUND OF THE DISCLOSURE

1. Field of the Disclosure

This invention relates to refrigerators, and more particularly to a refrigerator in which a vacuum space is formed between an outer case and an inner case of a body thereof for enhancing a heat insulating function.

2. Discussion of the Related Art

The refrigerator is a domestic appliance which forms a storage chamber temperature below zero or above zero degree for refrigerated or frozen storage of a storage object.

In general, the refrigerator is provided with the body having the storage space formed therein for storage of the storage object, and a door rotatably or slidably mounted to the body for opening/closing the storage space.

The body has the inner case to form the storage space, the outer case which houses the inner case, and an insulating material arranged between the inner case and the outer case.

The insulating material suppresses an external temperature from influencing the temperature of the storage space.

However, in order to produce an insulating effect by using the insulating material, it is required to secure a certain extent of thickness of the insulating material, implying that the insulating material becomes thicker as much, leading to have a thick wall between the inner case and the outer case, making the refrigerator bigger as much.

In the meantime, a recent trend of making the refrigerator compact calls for a requirement for making a volume of the storage space bigger while making an outside size smaller than before.

SUMMARY OF THE DISCLOSURE

Accordingly, this invention is directed to a refrigerator.

An object of this invention is to provide a refrigerator in which a vacuum space is formed between an outer case and an inner case for enhancing a heat insulating function and making an outside volume thereof compact.

Another object of this invention is to provide a refrigerator which may suppress or minimize dewing caused by a supporting portion which supports a vacuum space.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerator includes a body having a storage space for storing a predetermined storage object, wherein the body includes an inner case having the storage space, an outer case having an inside surface spaced a predetermined gap from an outside surface of the inner case to house the inner case, a vacuum space provided between the inner case and the outer case sealed to maintain a vacuum state for heat insulating between the inner case and the outer case, a supporting portion provided to contact with the outside surface of the inner case and the inside surface of the outer case to maintain a spaced state of the vacuum space, and a dewing preventive unit adjacent to the supporting portion for preventing dewing from taking place at the outer case by suppressing surface temperature drop of the outer case, which is caused by cold conducted from the inner case to the outer case through the supporting portion.

The dewing preventive unit is attached to the outside surface of the outer case, arranged adjacent to the outside surface of the outer case, or arranged adjacent to a contact point of the supporting portion to the inside surface of the outer case for reducing an extent of temperature drop of a surface of the outer case caused by cold transmitted to the outer case through the supporting portion.

The dewing preventive unit includes a heat spreading plate for spreading cold from the contact point of the supporting portion to the outer case to a place adjacent thereto.

The dewing preventive unit is a metal coated layer of a predetermined area on the outside surface of the outer case adjacent to the contact point of the supporting portion to the outer case.

The dewing preventive unit includes a heater provided to an outside of the outer case adjacent to the contact point of the supporting portion to the outer case.

The dewing preventive unit includes a hot pipe provided to an outside of the outer case adjacent to the contact point of the supporting portion to the outer case.

The dewing preventive unit includes a heat insulating member provided to a surface of the outer case adjacent to the contact point of the supporting portion to the outer case.

The dewing preventive unit is provided to an inside surface of the inner case adjacent to the contact point of the supporting portion to the outside surface of the inner case, for suppressing surface temperature drop of the outer case caused by cold transmitted to the outer case through the supporting portion.

The dewing preventive unit is an insulating member provided to the inside surface of the inner case at a position matched to the contact point of the supporting portion to the outside surface of the inner case.

In another aspect of the this invention, a refrigerator includes a body having a storage space for storing a predetermined storage object, a wall of the body, a vacuum space provided in the wall sealed to maintain a vacuum state for heat insulating between an inside of the wall and an outside of the wall, a supporting portion provided to contact with an one side and the other side of an inside of the wall to maintain a spaced state of the vacuum space, and a dewing preventive unit adjacent to the supporting portion for preventing dewing from taking place at the outer case by suppressing surface temperature drop of the outer case caused by cold conducted from the inner case to the outer case through the supporting portion.

The dewing preventive unit is attached to the outside surface of the wall, arranged adjacent to the outside surface of the wall, or arranged adjacent to a contact point of the supporting portion to the wall for reducing an extent of temperature drop of a surface of the outer case caused by cold transmitted to the outside surface of the wall through the supporting portion.

The dewing preventive unit includes a heat spreading plate for spreading cold from the contact point of the supporting portion to the outside surface of the wall to a place adjacent thereto.

The dewing preventive unit is a metal coated layer of a predetermined area on the outside surface of the wall adjacent to the contact point of the supporting portion to the wall.

The dewing preventive unit is a heater provided to the outside surface of the wall adjacent to the contact point of the supporting portion to the wall.

The dewing preventive unit includes a hot pipe provided to the outside surface of the wall adjacent to the contact point of the supporting portion to the wall.

The dewing preventive unit includes a heat insulating member provided to the outside surface of the wall adjacent to the contact point of the supporting portion to the wall.

The dewing preventive unit is provided to an inside surface of the wall adjacent to the contact point of the supporting portion to the wall, for suppressing surface temperature drop of the outer case caused by cold transmitted to the outside surface of the wall through the supporting portion.

The dewing preventive unit includes a heat insulating member provided to the inside surface of the wall at a position matched to the contact point of the supporting portion to the wall.

It is to be understood that both the foregoing general description and the following detailed description of this invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of this invention, examples of which are illustrated in the accompanying drawings. Wherever possible, the same reference numbers will be used throughout the drawings to refer to the same or like parts.

A word of "cold" used in this specification as a noun has a meaning opposite to a word of "heat" used as a noun which means warmth or hotness.

Figure 1:
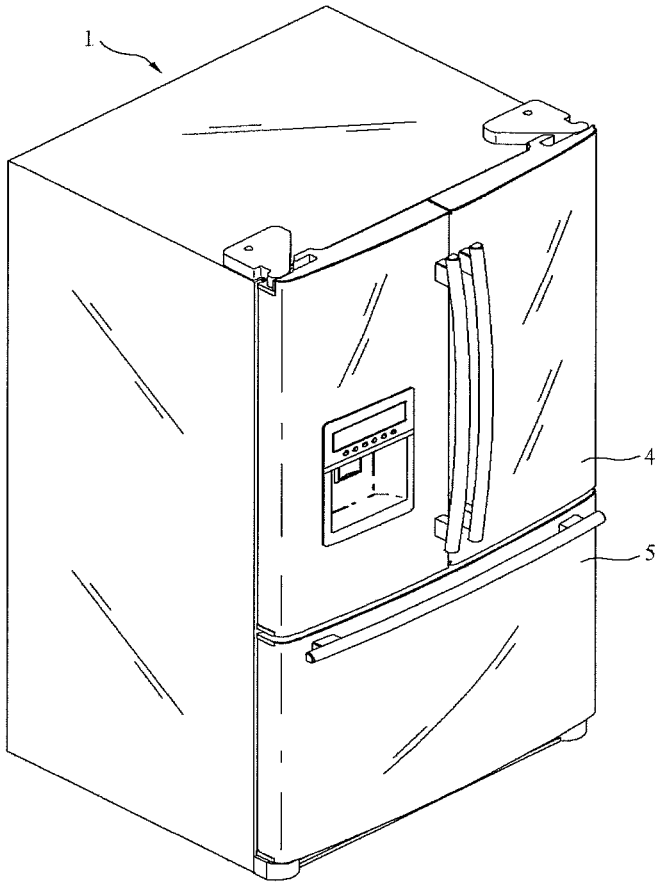
FIG. 1 illustrates a perspective view of a refrigerator in accordance with a preferred embodiment of this invention.

Referring to FIG. 1, the refrigerator includes a body 1 having a storage chamber formed therein, a first door rotatably provided to the body 1, and a second door 5 slidably provided to the body 1.

In this instance, the first door 4 has a function of, but not limited to, opening/closing a refrigerating chamber in the storage chamber, and the second door 5 has a function of, but not limited to, opening/closing a freezing chamber in the storage chamber.

Figure 2:
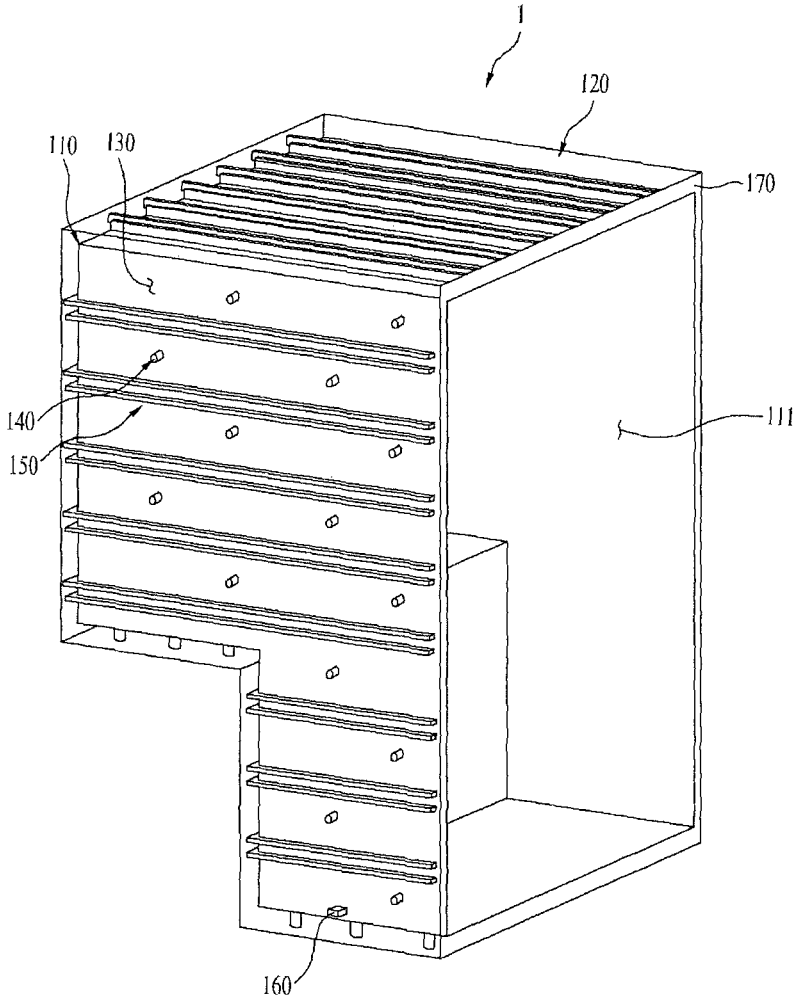
FIG. 2 illustrates a perspective view of a body of the refrigerator in accordance with a preferred embodiment of this invention, with an outer case thereof removed from a top side and a side thereof.

FIG. 2 illustrates a perspective view of a body of the refrigerator in accordance with a preferred embodiment of this invention, with an outer case thereof removed from a top side and a side thereof.

The body 1 has a structure including an inner case 110 which forms a predetermined storage space 111 therein, and an outer case 120 which forms a space for housing the inner case 110 therein and surrounds the inner case 110. The inner case 110 and the outer case 120 function as a wall which forms an exterior of the body 1 and the storage space 111 therein.

In this instance, the inner case 110 and the outer case 120 form a wall of the body 1.

The outer case 120 and the inner case 110 are spaced from each other to form a space which has no additional insulating material arranged therein, but only a vacuum maintained therein for heat insulation. That is, the wall of the body 1 is a double wall.

The inner case 110 may be an inside wall of the body 1, and the outer case 120 may be an outside wall of the body 1.

The vacuum space 130 formed between the outer case 120 and the inner case 110 maintains a state in which a medium which transmits heat between the inner case 110 and the outer case 120 is removed therefrom.

Therefore, the influence of warm air on an outside of the outer case 120 to a temperature of the inner case 110 may be prevented.

That is, the influence of a temperature of air on an outside of the body 1 to a change of a temperature of air on an inside of the storage space 111 may be prevented.

In order to make the vacuum space 130 between the inner case 110 and the outer case 120 to maintain a shape thereof, a supporting portion 140 is required, which serves as a spacer that maintains a gap between the inner case 110 and the outer case 120. The supporting portion 140 is arranged to be in contact with an outside surface of the inner case 110 and an inside surface of the outer case 120.

The supporting portion 140 may be provided such that the supporting portion 140 is arranged projected from the outside surface of the inner case 110 to make a surface to surface contact with the inside surface of the outer case 120, or is arranged projected from the inside surface of the outer case 120 to make a surface to surface contact with the outside surface of the inner case 110.

Or, the supporting portion 140 may be arranged both at the inside surface of the outer case 120 and at the outside surface of the inner case 110.

In this case, it is preferable that positions of the supporting portion 140 arranged at the inside surface of the outer case 120 and the positions of the supporting portion 140 arranged at the outside surface of the inner case 110 are, not overlap, but alternate, with one another.

In the meantime, reinforcing ribs 150 may be provided to the outside surface of the inner case 110 and the inside surface of the outer case 120 for reinforcing strength thereof, additionally.

Since thicknesses of the inner case 110 and the outer case 120 are not thick, the inner case 110 and the outer case 120 are liable to distort by an external impact, or deform at the time of evacuation to form the vacuum space 130.

Accordingly, the reinforcing ribs 150 are arranged on an outside surface of the inner case 110 or the inside surface of the outer case 120 for reinforcing the strength.

In this instance, it is preferable that the reinforcing ribs 150 are plural, and arranged spaced from one another on the outside surface of the inner case 110 or on the inside surface of the outer case 120.

In the meantime, a getter 160 is provided to the vacuum space 130 for collecting gas liable to present in the vacuum space 130, thereby preventing heat transfer caused by the gas liable to form by a chemical reaction of the outer case 120 or the inner case 110, in advance.

It is preferable that the getter 160 is provided to a ceiling or a bottom of the vacuum space 130.

The getter 160 has a substance which has a strong action of adsorbing residual gas molecules from the vacuum space 130 or making a chemical reaction therewith to form a solid compound.

Since it is difficult to obtain an adequate vacuum in the vacuum space 130 only with a vacuum pump technically, and it also costs high, the getter 160 is used.

There are different kinds of getters 160. If the getter 160 has a strong adsorbing action, the getter 160 is called as a flashed getter, and if the getter 160 is in a gaseous state with a strong chemical reaction, the getter 160 is called as a non-evaporable getter.

Presently, the getter 160 is formed of active charcoal, barium, magnesium, zirconium, red phosphorus, and so on.

In the meantime, the vacuum space 130 has a front covered with a front cover 170 which connects and seals front edges of the inner case 110 and the outer case 120.

Figure 3:
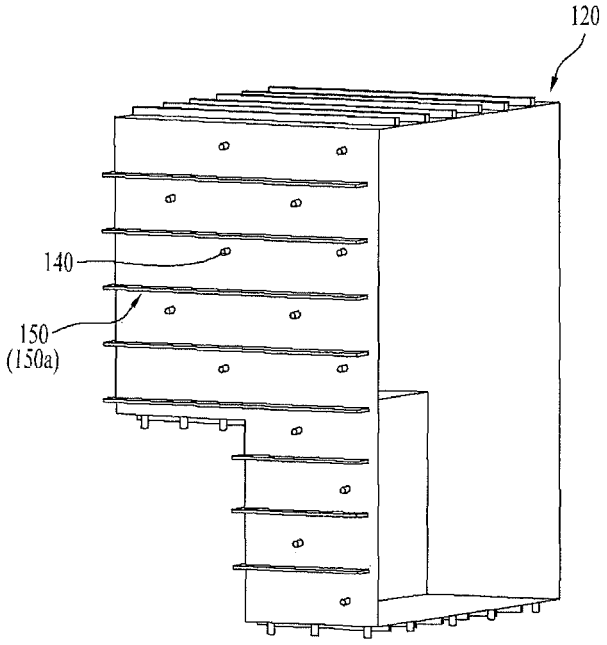
FIGS. 3A and 3B illustrate perspective views of an inner case and an outer case of a body of a refrigerator in accordance with a preferred embodiment of this invention, respectively.
Figure 3:
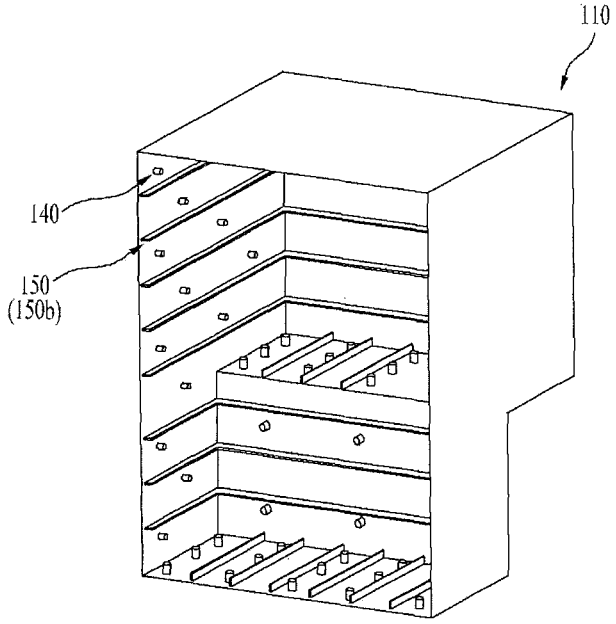

Referring to FIG. 3, the reinforcing ribs 150 and the supporting portions 140 are arranged spaced from each other not to overlap with each other. FIG. 3A illustrates the inner case 110, and FIG. 3B illustrates the outer case 120.

Though it is shown that the reinforcing ribs 150 are arranged in one direction (A front to rear direction) on the outside surface of the inner case 110 and the inside surface of the outer case 120, the reinforcing ribs 150 may be arranged in many directions to cross with one another.

In the meantime, it may be possible to reinforce the inner case 110 and the outer case 120, not by the reinforcing ribs 150, but by forming portions each of which is a bent portion of the inner case 110 or the outer case 120.

It is preferable that the supporting portion 140 is arranged on a surface between the reinforcing ribs 150.

In this instance, if the reinforcing ribs 150 arranged on the inside surface of the outer case 120 are called as outside reinforcing ribs 150*a*, and the reinforcing ribs 150 arranged on the outside surface of the inner case 110 are called as inside reinforcing ribs 150*b*, it is required that the outside reinforcing ribs 150*a* and the inside reinforcing ribs 150*b* are spaced not overlap with each other not to interfere with each other.

Since, if overlap, or interfere with each other, a thickness of the vacuum space 130 becomes thicker, in order to minimize the thickness of the vacuum space 130, the overlap or interference between the inside reinforcing ribs 150*b* and the outside reinforcing ribs 150*a* are prevented.

Accordingly, it is preferable that the inside reinforcing ribs 150*b* and the outside reinforcing ribs 150*a* are arranged alternately in the vacuum space 130.

That is, it is preferable that, at a particular region of the vacuum space 130, the reinforcing ribs 150 are arranged in an order of the inside reinforcing ribs 150*b*—the outside reinforcing ribs 150*a*—the inside reinforcing ribs 150*b*—the outside reinforcing ribs 150*a*.

This is for maintaining a gap between the inner case 110 and the outer case 120 of the vacuum space 130 on the whole.

Figure 4:
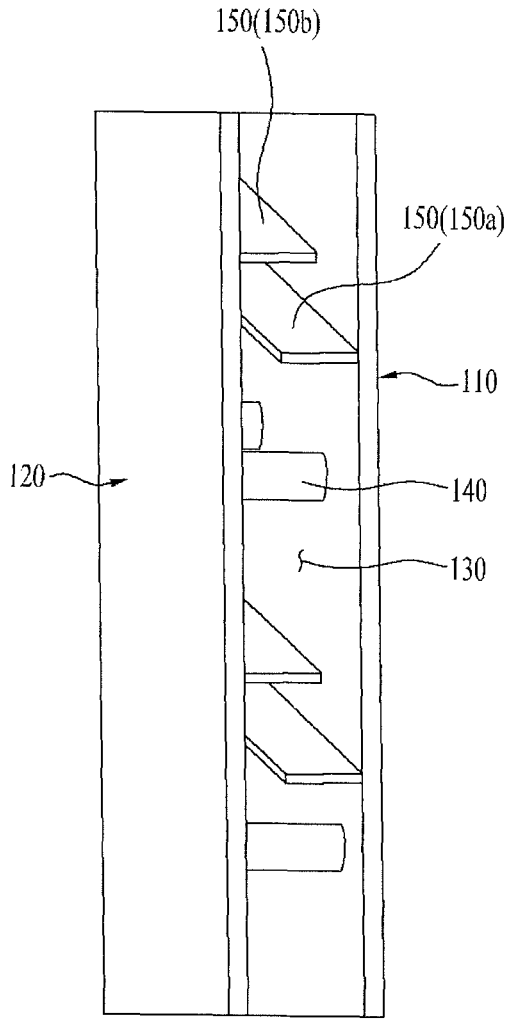
FIG. 4 illustrates a perspective view of a portion of a vacuum space in accordance with a preferred embodiment of this invention.

FIG. 4 illustrates a perspective view of a portion of a vacuum space 130 in accordance with a preferred embodiment of this invention, showing the inside reinforcing ribs 150*a* and the outside reinforcing ribs 150*b* arranged spaced from each other not to overlap with each other.

In the meantime, it is preferable that each of the outside reinforcing ribs 150*b* and the inside reinforcing ribs 150*a* has a projected length or a projected height smaller than the vacuum space 130, for preventing the outside reinforcing ribs 150*b* from being in contact with the outside surface of the inner case 110, or the inside reinforcing ribs 150*a* from being in contact with the inside surface of the outer case 120.

If the there is the contact of the reinforcing rib 150, since the heat transfer is liable to take place through the portion, in order to prevent this from taking place, it is preferable that the projected length or the projected height of each of the outside reinforcing ribs 150*b* and the inside reinforcing ribs 150*a* is formed smaller than the width of the vacuum space 130.

In the meantime, it is required that the supporting portion 140 has a size matched to the width of the vacuum space 130 for the supporting portion 140 to perform a function of maintaining the width of the vacuum space 130.

However, since the heat transfer is liable to take place through the supporting portion 140, it is preferable that a number of the supporting portion 140 is minimized as far as the width of the vacuum space 130 is maintained by the supporting portion 140.

In the meantime, in order to maintain the vacuum space 130, it is required that the inner case 110 and the outer case 120 are formed of metal.

If the inner case 110 and the outer case 120 are formed of resin, which has micro holes therein, maintenance of the vacuum state may fail.

In the meantime, it is required that the outer case 120 and the reinforcing ribs 150 are also formed of metal. This is because it is preferable that coupling thereof to the inner case 110 and the outer case 120 is made by welding.

And, if the outer case 120 and the reinforcing ribs 150 are also formed of, not the metal, but the resin, allowing gas or air to discharge from the micro hole or porous in a surface thereof to break the vacuum state, it is preferable that the outer case 120 and the reinforcing ribs 150 are formed of the metal.

However, since the supporting portion 140 is in surface to surface contact with the inner case 110 and the outer case 120, cold may transfer from the storage space in the inner case 110 to the outer case 120 through the supporting portion 140.

In this case, a surface of a portion of the outer case 120 in contact with the supporting portion 140 is cooled down cooler than other portion and external air locally, making a surface temperature of the contact portion to be lower than a dew point of the external air to cause dewing to form water drops.

In order to prevent the dewing from taking place, it is required to suppress the cold from flowing toward the outer case 120 by arranging a heat transfer suppressing element on an outside of the outer case 120.

Or, alternatively, it may be required to dissipate or spread the cold transmitted from the inner case 110 to the outer case 120.

Figure 5:
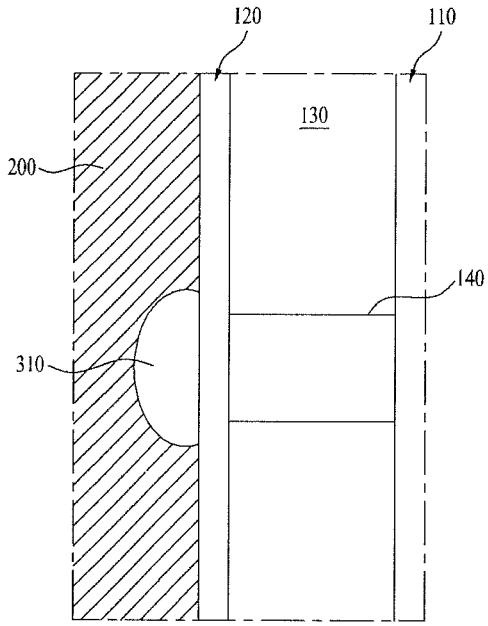
FIG. 5 illustrates a section of a dewing preventive unit in accordance with a first preferred embodiment of this invention.

Referring to FIG. 5, by arranging the supporting portion 140 in the vacuum space 130 between the inner case 110 and the outer case 120, the gap between the inner case 110 and the outer case 120 is maintained, as well as deformation of the vacuum space 130 is prevented.

However, when the refrigerator of this invention is in operation, since an inside temperature of the inner case 110 becomes a frozen storage temperature, or a refrigerated storage temperature, which has a difference from a room temperature on an outside of the outer case 120, the cold flows from the inner case 110 toward the outer case 120.

Since all of the inner case 110, the outer case 120 and the supporting portion 140 are formed of metal, and the supporting portion 140 is in surface to surface contact with the inside surface of the outer case 120 and the outside surface of the inner case 110, such cold conduction takes place.

If such cold conduction takes place, the portion of the outer case 120 in contact with the supporting portion 140 becomes to have a temperature lower than other portions, which is, in general, lower than the dew point of the room temperature, the dewing takes place at the portion to form water drops.

Therefore, it is required to mount the dewing preventive unit at a portion adjacent to a portion the supporting portion 140 is mounted thereto for suppressing local temperature drop at the portion of the outer case 120 in contact with the supporting portion 140.

By mounting a heat insulating member 310 to an opposite side of the inside surface to which the supporting portion 140 is in contact thereto, i.e., the outside surface of the outer case 120, the temperature drop at the portion is prevented.

In this instance, it is preferable that the heat insulating member 310 is formed of Styrofoam or polyurethane.

An unexplained reference numeral 200 denotes a cover member for decorating an outside of the outer case 120.

The heat insulating member 310 may not be arranged to an inside of the vacuum space 130 because it is liable that the Styrofoam of the heat insulating member 310 emits gas from the porous thereof to the vacuum space 130 to break the vacuum state.

Figure 6:
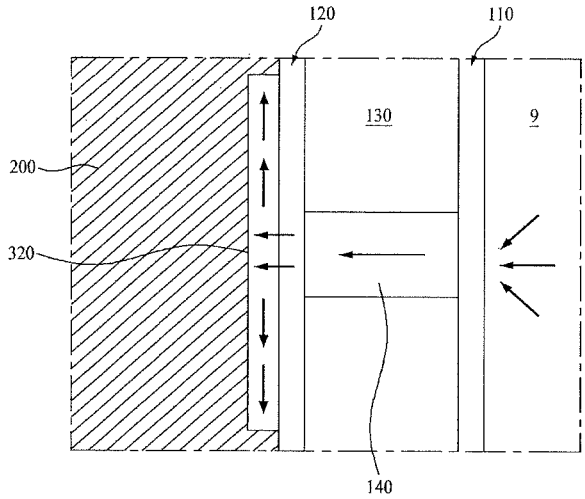
FIG. 6 illustrates a section of a dewing preventive unit in accordance with a second preferred embodiment of this invention.

FIG. 6 illustrates a section of a dewing preventive unit in accordance with a second preferred embodiment of this invention.

The second embodiment suggests the dewing preventive unit formed of a heat spreading plate 320 provided to an outside surface of the outer case 120.

The heat spreading plate 320 is arranged adjacent to a place the supporting portion 140 is mounted thereto, for spreading the cold transmitted to the outer case 120 from the inner case 110 through the supporting portion 140, widely.

Since the inside temperature of the inner case 110 and the outside temperature of the outer case 120 is significant, if the cold transmitted to the outer case 120 through the supporting portion 140 is conducted only to a local portion, the dewing at the portion will be intensive.

However, if the heat spreading plate 320 of the embodiment is mounted, to distribute the cold from the outer case 120 to the heat spreading plate 320, an extent of overall temperature drop can be minimized.

It is preferable that a center point of the heat spreading plate 320 is arranged matched to the supporting portion 140, and it is preferable that the heat spreading plate 320 is formed of an aluminum or copper plate having good heat conductivity.

Or, instead of the heat spreading plate 320, a coat of metal having good conductivity applied to the portion to form a metal coated layer may make the heat spreading.

Figure 7:
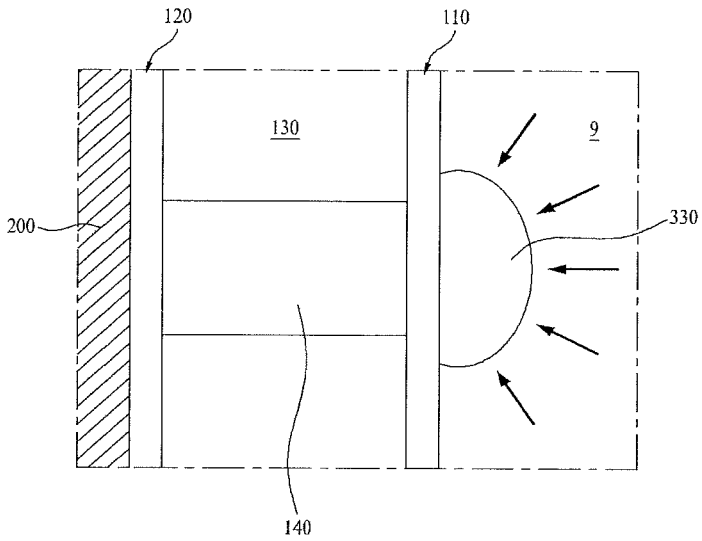
FIG. 7 illustrates a section of a dewing preventive unit in accordance with a third preferred embodiment of this invention.

FIG. 7 illustrates a section of a dewing preventive unit in accordance with a third preferred embodiment of this invention, suggesting a heat insulating member 330 mounted to the inside surface of the inner case for preventing cold from transmitting toward the supporting portion 140 from a space in the inner case 110, to prevent a surface temperature of the outer case 120 from dropping.

In detail, a position of the heat insulating member 330 is an opposite side of a point of the inner case 110 the supporting portion 140 is in contact thereto, and the heat insulating member 330 is projected inward from the inner case 110.

That is, since the supporting portion 140 is in contact with the outside surface of the inner case 110, it is preferable that the heat insulating member 330 is arranged at the inside surface of the inner case 110 which is an opposite side of the portion the supporting portion 140 is in contact.

Therefore, the heat insulating member 330 projected thus may be used as the dewing preventive member as well as a supporting portion of a shelf or a drawer.

Figure 8:
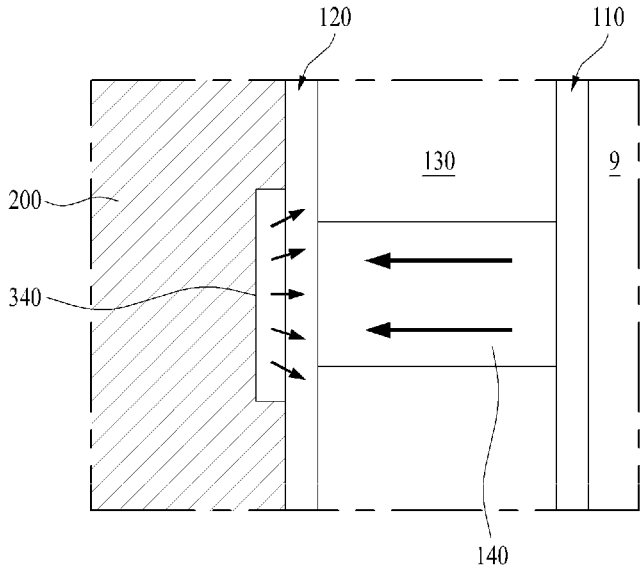
FIG. 8A illustrates a section of a dewing preventive unit in accordance with a fourth preferred embodiment of this invention.
FIG. 8B illustrates a section of a dewing preventive unit in accordance with a fifth preferred embodiment of this invention.
Figure 8:
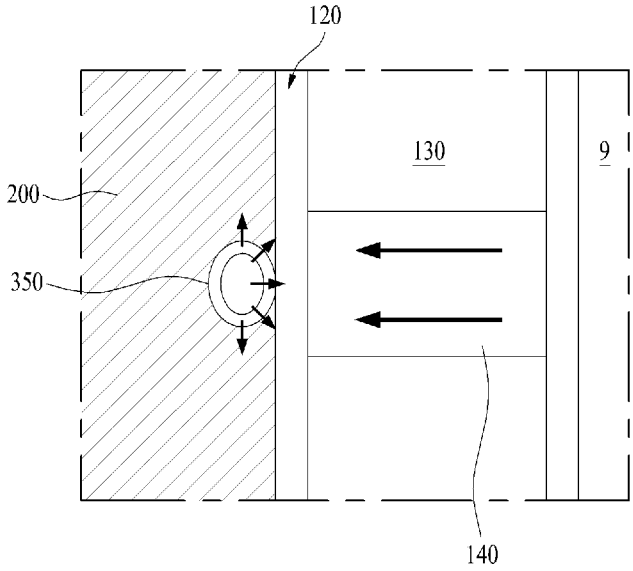

FIG. 8A illustrates a section of a dewing preventive unit in accordance with a fourth preferred embodiment of this invention, having a heater 340 provided to the outer case 120. Therefore, if the cold is transmitted to the outer case 120 through the supporting portion 140, since the heater 340 generates heat to prevent a surface temperature of the outer case 120 from dropping, the dewing may be prevented.

In this instance, the heater 340 is required to perform heat generation in an extent of preventing the surface temperature of the outer case 120 from dropping. If the heat generation is too high, the heat may transmit toward the inner case 110.

The heater 340 is arranged on the outside surface of the outer case 120 which is opposite to the inside surface of the outer case 120 the supporting portion 140 is in contact thereto. According to this, the local surface cooling may be prevented, and the dewing may also be prevented.

And, even if the dewing takes place adjacent to the point the supporting portion 140 is in contact thereto, the dew may be heated to vaporize.

FIG. 8B illustrates a section of a dewing preventive unit in accordance with a fifth preferred embodiment of this invention, suggesting a hot pipe 350 as the dewing preventive unit instead of the heater 340.

The hot pipe 350 is a refrigerant pipe connected between a compressor (Not shown) and a condenser (Not shown) for flow of the refrigerant. If the hot pipe 350 is arranged adjacent to a place the supporting portion 140 is mounted thereto, alike the heater 340, the hot pipe 350 heats a surface of the outer case 120 to suppress the surface temperature drop.

And, if the dewing takes place adjacent to the contact point of the supporting portion 140, the hot pipe 350 heats the place the dew taken place to evaporate the dew.

As has been described, the refrigerator of this invention has the following advantages.

The refrigerator of this invention has, not a general insulating material, but a vacuum space formed between the inner case and the outer case for suppressing heat transfer between the inner case and the outer case.

Since a heat insulating effect of the vacuum is significantly better than a heat insulating effect of the general insulating material, the refrigerator of this invention has a heat insulating effect better than the related art refrigerator.

In the meantime, in a case of the vacuum space, the heat insulating is made available only when a vacuum state is maintained regardless of the thickness (A gap between the inner case and the outer case, in a case of the general insulating material, it is required to make a thickness of the insulating material thicker to enhance the heat insulating effect, which thickness increase increases a size of the refrigerator.

Therefore, in comparison to the related art refrigerator, since the refrigerator of this invention permits to an outside size thereof while maintaining the storage space the same, a compact refrigerator may be provided.

The heat transfer between the inner case and the outer case through the supporting portion in surface to surface contact thereto for supporting the shape of the vacuum space may be suppressed, or heat transferred to the outer case may be spread or dissipated, thereby preventing dewing at the outer case from taking place.

It will be apparent to those skilled in the art that various modifications and variations can be made in this invention without departing from the spirit or scope of the inventions. Thus, it is intended that this invention covers the modifications and variations of this invention provided they come within the scope of the appended claims and their equivalents.

What is claimed is:

1. A refrigerator comprising:

a body having a storage space for storing a predetermined storage object, wherein the body includes;

an inner case having the storage space, the inner case formed from metal, an outer case having an inside surface spaced a predetermined gap from an outside surface of the inner case to house the inner case, the outer case formed from metal, a vacuum space provided between the inner case and the outer case sealed to maintain a vacuum state for heat insulating between the inner case and the outer case, a supporting portion provided to contact with the outside surface of the inner case and the inside surface of the outer case to maintain a spaced state of the vacuum space, the supporting portion formed from metal, wherein the supporting portion extends, through the vacuum space, from the outside surface of the inner case to the inside surface of the outer case or from the inside surface of the outer case to the outside surface of the inner case;

a reinforcing rib provided to the outside surface of the inner case or the inside surface of the outer case for reinforcing strength thereof, the reinforcing rib being different than the supporting portion and being spaced apart from the supporting portion such that the reinforcing rib does not overlap with the supporting portion;

a dewing preventive unit adjacent to the supporting portion for preventing dewing from taking place at the outer case by suppressing surface temperature drop of the outer case, which is caused by cold conducted from the inner case to the outer case through the supporting portion, the dewing preventive unit being located on the outside surface of the outer case at a location that is opposite to a portion of the inside surface of the outer case that the supporting portion contacts;

a plurality of supporting portions that are each provided to contact with the outside surface of the inner case and the inside surface of the outer case to maintain the spaced state of the vacuum space, the supporting portion being one of the plurality of supporting portions; and a plurality of reinforcing ribs that are each provided to the outside surface of the inner case or the inside surface of the outer case for reinforcing strength thereof, the reinforcing rib being one of the plurality of reinforcing ribs, wherein the plurality of supporting portions and the plurality of reinforcing ribs are arranged spaced apart from each other such that the plurality of supporting portions and the plurality of reinforcing ribs do not overlap with each other, and wherein each of the plurality of supporting portions are located entirely within the vacuum space, each of the plurality of reinforcing ribs are located entirely within the vacuum space, and each of the plurality of reinforcing ribs have a length that is less than a width of the vacuum space such that each of the plurality of reinforcing ribs contacts one of the outside surface of the inner case and the inside surface of the outer case, but does not contact the other of the outside surface of the inner case and the inside surface of the outer case.

2. The refrigerator as claimed in claim 1, wherein the dewing preventive unit is arranged adjacent to a contact point of the supporting portion to the inside surface of the outer case for reducing an extent of temperature drop of a surface of the outer case caused by cold transmitted to the outer case through the supporting portion.

3. The refrigerator as claimed in claim 2, wherein the dewing preventive unit includes a heat spreading plate for spreading cold from the contact point of the supporting portion to the outer case to a place adjacent thereto.

4. The refrigerator as claimed in claim 2, wherein the dewing preventive unit is a metal coated layer of a predetermined area on the outside surface of the outer case adjacent to the contact point of the supporting portion to the outer case.

5. The refrigerator as claimed in claim 2, wherein the dewing preventive unit includes a heater provided to an outside of the outer case adjacent to the contact point of the supporting portion to the outer case.

6. The refrigerator as claimed in claim 2, wherein the dewing preventive unit includes a hot pipe provided to an outside of the outer case adjacent to the contact point of the supporting portion to the outer case.

7. The refrigerator as claimed in claim 2, wherein the dewing preventive unit includes a heat insulating member provided to a surface of the outer case adjacent to the contact point of the supporting portion to the outer case.

8. The refrigerator as claimed in claim 1, wherein the vacuum space is devoid of heat insulation material provided between the outside surface of the inner case and the inside surface of the outer case, and the supporting portion extends, through the vacuum space, directly from the outside surface of the inner case to the inside surface of the outer case to maintain the spaced state of the vacuum space.

9. The refrigerator as claimed in claim 1, wherein the plurality of reinforcing ribs include a first set of reinforcing ribs that contact the outside surface of the inner case, but not the inside surface of the outer case and a second set of reinforcing ribs that contact the inside surface of the outer case, but not the outside surface of the inner case.

10. The refrigerator as claimed in claim 1, further comprising:

a getter located within the vacuum space and configured to collect gas present in the vacuum space.

11. A refrigerator comprising:

a body having a storage space for storing a predetermined storage object;

a wall of the body;

a vacuum space provided in the wall sealed to maintain a vacuum state for heat insulating between an inside of the wall and an outside of the wall, the inside of the wall and the outside of the wall being formed from metal;

a supporting portion provided to contact with one side of the inside of the wall and one side of the outside of the wall to maintain a spaced state of the vacuum space, the supporting portion provided inside of the vacuum space and formed from metal, wherein the supporting portion extends, through the vacuum space, from the outside surface of the inside of the wall to the inside surface of the outside of the wall or from the inside surface of the outside of the wall to the outside surface of the inside of the wall;

a dewing preventive unit adjacent to the supporting portion for preventing dewing from taking place at the outside of the wall by suppressing surface temperature drop of the outside of the wall caused by cold conducted from the inside of the wall to the outside of the wall through the supporting portion, the dewing preventive unit being located on the outside surface of the outside of the wall at a location that is opposite to a portion of the inside surface of the outside of the wall that the supporting portion contacts;

a plurality of supporting portions that are each provided to contact with the outside surface of the inner case and the inside surface of the outer case to maintain the spaced state of the vacuum space, the supporting portion being one of the plurality of supporting portions; and a plurality of reinforcing ribs that are each provided to the outside surface of the inner case or the inside surface of the outer case for reinforcing strength thereof, the reinforcing rib being one of the plurality of reinforcing ribs, wherein the plurality of supporting portions and the plurality of reinforcing ribs are arranged spaced apart from each other such that the plurality of supporting portions and the plurality of reinforcing ribs do not overlap with each other, and wherein each of the plurality of supporting portions are located entirely within the vacuum space, each of the plurality of reinforcing ribs are located entirely within the vacuum space, and each of the plurality of reinforcing ribs have a length that is less than a width of the vacuum space such that each of the plurality of reinforcing ribs contacts one of the outside surface of the inner case and the inside surface of the outer case, but does not contact the other of the outside surface of the inner case and the inside surface of the outer case.

12. The refrigerator as claimed in claim 11, wherein the dewing preventive unit is arranged adjacent to a contact point of the supporting portion to the wall for reducing an extent of temperature drop of a surface of the outer case caused by cold transmitted to the outside surface of the wall through the supporting portion.

13. The refrigerator as claimed in claim 12, wherein the dewing preventive unit includes a heat spreading plate for spreading cold from the contact point of the supporting portion to the outside surface of the wall to a place adjacent thereto.

14. The refrigerator as claimed in claim 12, wherein the dewing preventive unit is a metal coated layer of a predetermined area on the outside surface of the wall adjacent to the contact point of the supporting portion to the wall.

15. The refrigerator as claimed in claim 12, wherein the dewing preventive unit is a heater provided to the outside surface of the wall adjacent to the contact point of the supporting portion to the wall.

16. The refrigerator as claimed in claim 12, wherein the dewing preventive unit includes a hot pipe provided to the outside surface of the wall adjacent to the contact point of the supporting portion to the wall.

17. The refrigerator as claimed in claim 12, wherein the dewing preventive unit includes a heat insulating member provided to the outside surface of the wall adjacent to the contact point of the supporting portion to the wall.

18. The refrigerator as claimed in claim 11, wherein the supporting portion extends, through the vacuum space, from the outside surface of the inside of the wall to the inside surface of the outside of the wall and all parts of the supporting portion are located inside of the vacuum space.

* * * * *